United States Patent [19]

Schempp

[11] 4,139,368

[45] Feb. 13, 1979

[54] METALLURGICAL METHOD

[75] Inventor: Eberhard G. Schempp, Pittsburgh, Pa.

[73] Assignee: Pennsylvania Engineering Corporation, Pittsburgh, Pa.

[21] Appl. No.: 840,785

[22] Filed: Oct. 11, 1977

[51] Int. Cl.[2] ..... C21C 5/34

[52] U.S. Cl. ..... 75/52; 75/60

[58] Field of Search ..... 75/59, 60

[56] References Cited

U.S. PATENT DOCUMENTS

| | | | |
|---|---|---|---|
| 3,046,107 | 7/1962 | Nelson | 75/59 |
| 3,706,549 | 12/1972 | Knuppel | 75/60 |
| 3,751,242 | 8/1973 | Knuppel | 75/60 |

*Primary Examiner*—P. D. Rosenberg

*Attorney, Agent, or Firm*—Fred Wiviott

[57] ABSTRACT

A method of treating ferrous metal in a metallurgical vessel having a plurality of two-pipe tuyeres extending generally upwardly through the vessel bottom and in spaced apart relation relative to each other. A flux, such as line, is first blown into the ferrous metal charge through the center tuyere pipe along with the process gas and a second gas is delivered to the outer tuyere pipe. After fluxing, a first process gas consisting principally of oxygen is blown into the charge through the center tuyere pipe along with a sheath of hydrocarbon shielding fluid delivered through the outer tuyere pipe. After a significant portion of carbon oxidation has proceeded to the point where excess oxygen would tend to oxidize chromium or iron, argon is mixed with the oxygen in the center tuyere pipe to the point where it equals or exceeds the proportion of oxygen while the delivery of hydrocarbon shielding fluid is continued through the outer tuyere pipe.

3 Claims, 1 Drawing Figure

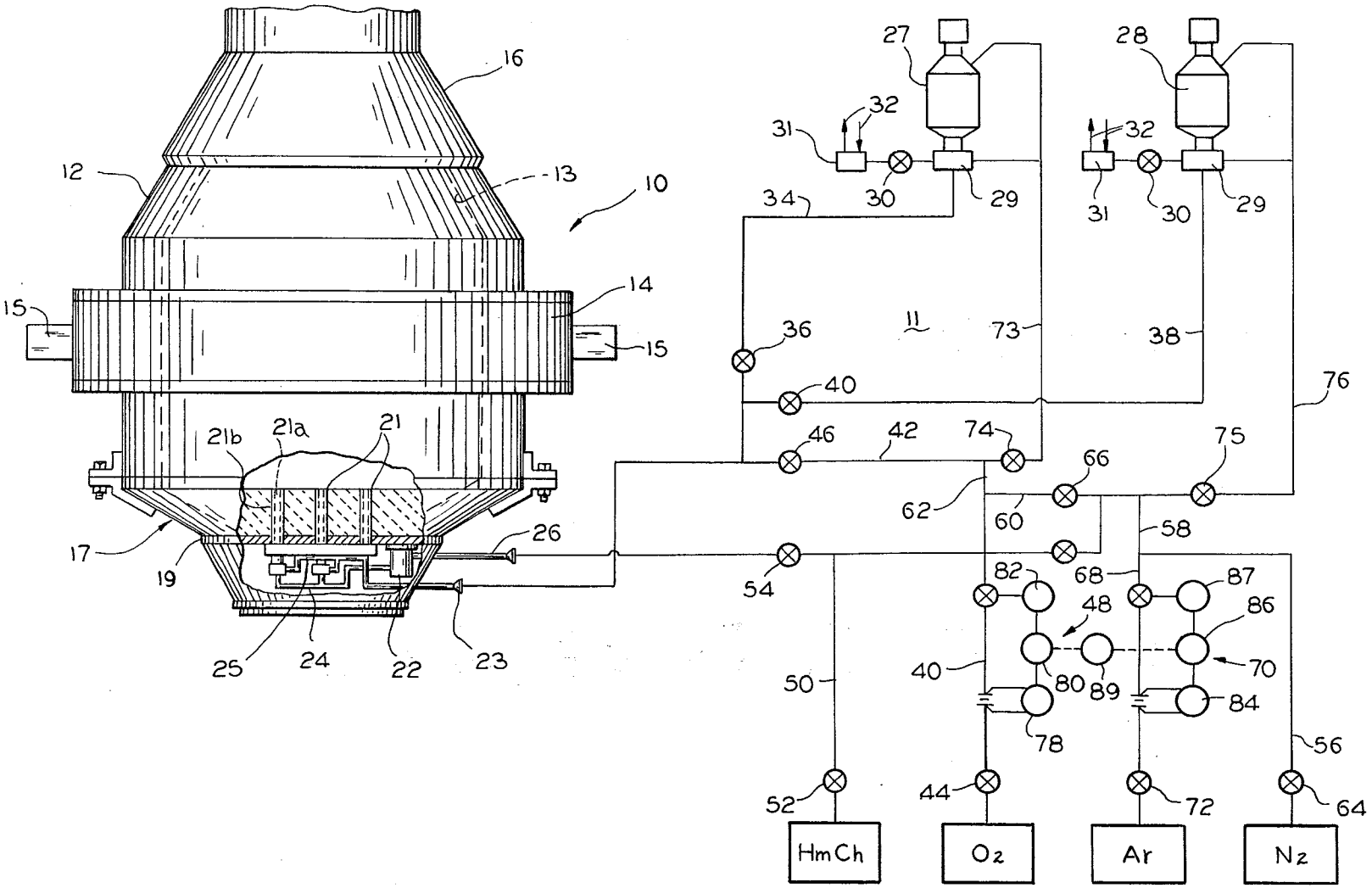
N2
Ar
O2
HmCh

METALLURGICAL METHOD

BACKGROUND OF THE INVENTION

One type of metallurgical vessel known as the argon-oxygen or AOD converter consists of a pivotable, generally pear-shaped vessel having an upper opening. A plurality of tuyeres, generally two or three in number, extend radially through the side wall of the vessel and they are spaced 40° to 60° apart, usually in a horizontal position, 17 to 25 centimeters above the flat vessel bottom. This places the inner ends of the tuyeres below bath depth which is typically one meter.

In a typical conversion process, the AOD vessel is charged with electric furnace hot metal containing between 0.8 and 1.5% carbon. A mixture of oxygen and argon having a ratio of about 3 parts oxygen to 1 part argon is blown through the center tuyere while argon or air is delivered through the outer tuyere pipe as a coolant or shielding fluid. During the process cycle, the ratio of argon and oxygen delivered to the center tuyere pipe is reversed in programmed steps.

Argon-oxygen vessels are commonly supported on a trunnion ring having radially extending trunnion pins supported on bearings. One trunnion pin is also coupled to a drive mechanism whereby the vessel may be tilted for pouring, deslagging and sampling.

The argon-oxygen process suffers a disadvantage of relatively high cost as a result of refractory and equipment wear and high argon consumption. For example, the refractory surrounding the tuyeres in AOD vessels erodes relatively rapidly despite the use of expensive argon as a cooling fluid. Also, as a result of the blowing pattern, AOD vessels have a tendency to oscillate causing wear in the support bearings and drive assembly.

SUMMARY OF THE INVENTION

It is an object of the invention to provide a new and improved metallurgical method.

A further object of the invention is to provide an argon-oxygen metallurgical conversion method wherein there is a significant cost saving over conventional argon-oxygen processes.

A further object of the invention is to provide an argon-oxygen process wherein refractory erosion and drive system wear is minimized.

These and other objects and advantages of the present invention will become more apparent from the detailed description thereof taken with the accompanying drawings.

BRIEF DESCRIPTION OF THE DRAWINGS

The single drawing FIGURE schematically illustrates a metallurgical apparatus in which the method according to the present invention may be practiced.

DETAILED DESCRIPTION OF THE PREFERRED EMBODIMENT

The system in which the method according to the invention may be practiced consists of a bottom-blown metallurgical vessel 10 and a system 11 for supplying process gases and other materials.

The vessel 10 includes a metallic shell 12 and a refractory lining 13. A conventional trunnion ring 14 is provided for supporting the vessel 10 and has a trunnion pin 15 extending from each of its opposite sides. The trunnion pins 15 are suitably supported in a well-known manner on bearing structures (not shown) and are coupled to a suitable drive mechanism (not shown) for tilting vessel 10 to each of a plurality of positions as may be required during a process cycle. A smoke hood 16 may be disposed above the open, upper end of vessel 10 when the latter is in its vertical position as illustrated in the drawing to prevent discharge of pollutants during operation of the vessel.

The vessel 10 may have a removable refractory bottom 17 having a bottom plate 19 for supporting a plurality of tuyeres 21 which extend through openings 22 in refractory bottom 17. The tuyeres 21 are preferably arranged in a symmetrical pattern and each includes an inner tuyere pipe **21*a* and an outer tuyere pipe 21*b* both of which are adapted to be connected to the gas supply system 11. Inner tuyere pipe 21*a* defines a first tuyere passage and pipe 21*b* is larger than and spaced from pipe 21*a* to provide a second tuyere passage. Also affixed to the bottom plate 19 is a lime distributor 22 connected to an oxygen input pipe 23 and by manifold 24 to the inner tuyere pipes 21*a*. Each of the outer tuyere pipes 21*b* are similarly connected by manifold 25 to a shielding fluid inlet pipe 26**.

The gas and material supply system 11 includes a pair of vessels 27 and 28 in which materials such as burnt lime, limestone, iron oxide, carbon, flurospar or other desulfurizing agents may be stored. While only two vessels 27 and 28 are shown, it will be understood that there may be as many pressure vessels as there are types of powdered materials which are to be injected into the molten metal within the vessel 10.

It will be appreciated that it is necessary to mix the powdered materials from the vessels 27 and 28 with entraining gas in a definite proportion. For this purpose, the bottom of each vessel 27 and 28 is provided with a mixing device 29, the details of which are not shown but which are well known in the art. For example, the device 29 may be of a type which withdraws powdered material from its associated vessel and injects it into the gas stream. Each mixing device 29 may be operated by a motive means 30 having a controller 31 responsive to input signals from a control (not shown) as symbolized by arrows 32.

The mixing devices 29 are connected to as many sources of gas as they may be entrained. As, for example, dephosphorizing agents may be stored in vessel 24 for being entrained in the oxygen stream, while desulfurizing agents may be disposed in vessel 26 for being entrained in the argon or nitrogen. The output of mixing chamber 29 is connected by pipe 34 and valve 36 to the inlet pipe 23 of mixing chamber 22 and the outlet of pressure vessel 27 is similarly connected thereto by pipe 38 and valve 40. Oxygen may be delivered from a source labeled $O_2$ directly to inlet pipe 23 through pipes 40 and 42, valves 44 and 46, and flow controller 48. Similarly, pipe 50 and valves 52 and 54 connect the hydrocarbon shielding fluid source labeled HmCn to the inlet pipe 26. Nitrogen from source labeled $N_2$ may be coupled to the inlet pipe 23 through pipes 56, 58, 60, 62 and 42 and valves 64, 66 and 46. Argon from source labeled Ar may also be coupled to pipe 23 through pipes 42, 58, 60, 62, 68, flow controller 70 and valves 46, 66 and 72. The argon and nitrogen sources may also be coupled to tank 27 through pipe 73 and valve 74 and to vessel 28 through valve 75 and pipe 76.

The first flow controller 48 includes any suitable means for controlling gas flow rate such as a flow meter 78 interposed in pipe 40 and connected to a flow controller 80 for controlling a flow control valve 82 also connected into pipe 40. Flow meter 78 may be any well known type of device which is operative to produce an electrical output signal functionally related to the gas flow rate in pipe 40. The controller 80 is electrically coupled to flow meter 78 and is operative to provide an output control signal to flow control valve 82 which is functionally related to its received input signal and valve 82 is operative to control the flow rate of gas in pipe 40 in relation to its received signal.

The argon flow controller assembly 70 similarly includes a flow meter 84, a controller 86 and a flow control valve 87 which are interconnected to each other and operative in a manner similar to that discussed with respect to the flow control assembly 75 and accordingly, the assembly 70 will not be discussed in detail. The controllers 80 and 86 are adjustable in relation to a received input signal so that the proportion of argon and oxygen which may be delivered to inlet pipe 24 can be adjusted. Controllers 80 and 86 are also coupled to the respective flow meters 78 and 84 for receiving signals functionally related to the actual flow rate. Controllers 80 and 86 are then operative to provide corrective signals so that the desired gas flow ratios can be achieved. A flow controller which may be employed for this purpose is Model 53-EL-3311BE1B manufactured by Fisher Porter Control Corporation.

A gas ratio controller 89 is electrically connected to controllers 80 and 86 for receiving signals functionally related to the rate of oxygen and argon delivery and is operative to provide corrective signals in relation with either a preset program or manual adjustments which may be provided by an operator. In this manner, the ratio of argon to oxygen supplied to the inlet pipe 26 may be controlled.

In the performance of the method according to the present invention, vessel 10 initially received a metallic charge. The specific charge, of course, depends upon the chemical balance of the desired end product and the availability of materials. For example, a solid charge such as scrap iron, scrap steel, liquid pig iron, iron oxide, or iron bearing materials in other solid form may be charged into the vessel after which a charge of liquid pig iron is added. Alternately, solely a liquid charge may be provided. Prior to the liquid charge, the solid charge may be heated by delivering a fuel such as propane, natural gas or light oil to the outer tuyere pipes **21*b* and oxygen to the inner tuyere pipes 21*a*. A nonoxidizing gas such as nitrogen or argon may be delivered to the both tuyere pipes after the preheating step and during the delivery of the molten metal charge. It will be appreciated that the vessel will normally be tilted to receive the various metallic charges and will be returned to its upright position and beneath gas collecting hood 16** before the oxygen is delivered. During the periods of vessel turn-up and turn-down, nonoxidizing gas such as nitrogen or argon is delivered to each of the tuyere pipes to prevent the backflow of molten metal.

After charging has been completed, the liquid metal charge is blown with fluxes. For dephosphorization, this will normally consist of lime entrained in the oxygen stream and delivered through the inner tuyere pipe while hydrocarbon shielding fluid through the outer pipe. On the other hand, if desulfurization is required, lime is entrained in either argon or oxygen and delivered to the center tuyere pipe while the same gas is delivered through the outer tuyere pipe. After desulfurization or dephosphorization, the main oxygen blow commences during which time, oxygen or a mixture of oxygen and argon is delivered to the center tuyere pipe and a hydrocarbon shielding fluid delivered through the outer tuyere pipe.

In the production of stainless steel, the charge would generally include chromium either in the form of chromium containing scrap or chromium containing hot metal. In order to avoid the oxidation of chromium, argon will normally be mixed with the oxygen during the main oxygen blow and the proportion of argon to oxygen will be increased during the main oxygen blow. For example, the initial ratio of oxygen to argon will be about 3 to 1 and this will be increased in increments by the flow controller 89 which operates the controllers 48 and 70 such that the final ratio of argon to oxygen will be about 3 to 1. As those skilled in the art will appreciate, chromium oxidation is prevented by the reduction of the carbon dioxide partial pressure within the molten metal by the action of argon dilution.

In the case of a low carbon steel or electric furnace steels which are alloyed with silicon, a rapid increase in iron oxidation normally occurs as carbon is oxidized during the main oxygen blow. Iron oxidation is minimized, however, by the gradual introduction of argon commencing at a point when the carbon level falls to about 0.02%. Specifically, the proportion of argon is gradually increased from about zero to fifty percent by weight until the end of the main oxygen blow. During this period, both in the case of stainless steel and carbon steels, hydrocarbon shielding fluid will be delivered to the outer tuyere pipe while oxygen and/or oxygen argon mixture is delivered to the inner tuyere pipe.

After the completion of the main oxygen blow, the bath may be purged of dissolved gases such as hydrogen and oxygen by an argon purge during which argon is delivered through both the inner and outer tuyere passages.

Because hydrocarbon shielding fluid is used as a cooling medium during the oxygen and argon oxygen blowing periods, the process is substantially cheaper than the AOD process wherein argon is employed as a cooling medium. In addition, substantially greater tuyere and refractory life as a result of the use of hydrocarbon shielding fluid as opposed to argon as a cooling medium. Further, by injecting the process gases upwardly and in a symmetrical pattern, the tendency for vessel oscillation is minimized thereby prolonging the life of the bearings and drive mechanism.

In a typical example employing a 30 ton vessel with six ½" tuyeres, the charge might be electric furnace hot metal containing about 0.8–1.5 carbon and about 8% chromium while a final specification might be a carbon level of 0.025% and an 18.8% chromium level. Oxygen is delivered at a rate of about 67 normal cubic meters ($Nm^3$) through the center tuyere would be typical. As the carbon level is reduced, argon is introduced into the oxygen stream at an increasing rate while the total flow rate remains substantially the same until a ratio of argon to oxygen of 3 to 1 by volume exists.

While only a few embodiments of the present invention have been illustrated and described, it is not intended to be limited thereby but only by the scope of the appended claims.

I claim:

1. A method of treating molten ferrous metal to produce low carbon steel comprising the steps of containing said metal in a metallurgical vessel, delivering oxygen to said molten metal vertically upwardly through the bottom of said vessel during an initial period to reduce the level of carbon in said metal and delivering a hydrocarbon shielding fluid to said vessel in surrounding relation to said oxygen, continuing the reduction of carbon until the level thereof falls to about 0.02% and then mixing progressively larger proportions of argon with said oxygen during a second period, adjusting the flow rates of said argon and oxygen so that initially the major portion of the gas mixture delivered through said tuyere passage during said second period is oxygen and a minor portion is argon, increasing the proportion of argon and decreasing the proportion of oxygen in said mixture as the percentage of carbon in said ferrous metal further decreases until the proportion of said argon delivered is at least approximately equal to said oxygen.

2. The method set forth in claim 1 and including the step of delivering lime and an inert gas to said molten metal prior to the commencement of said initial period.

3. A method of treating molten ferrous metal comprising the steps of containing said metal in a metallurgical vessel, delivering lime and an inert gas to said molten metal vertically upwardly through the bottom of said vessel during an initial period, delivering oxygen to said metal during a second period commencing with the termination of said first period and delivering a hydrocarbon shielding fluid to said vessel in surrounding relation to said oxygen during said second period, mixing progressively larger proportions of argon with said oxygen during a second period, adjusting the flow rates of said argon and oxygen so that initially the major portion of the gas mixture delivered to said metal during said second period is oxygen and a minor portion is argon, increasing the proportion of argon and decreasing the proportion of oxygen in said mixture as the percentage of carbon in said ferrous metal decreases until the proportion of said argon delivered is at least approximately equal to said oxygen.

* * * * *